United States Patent [19]

Braun

[11] Patent Number: 4,949,102

[45] Date of Patent: Aug. 14, 1990

[54] BUBBLE JET PRINT HEAD ORIFICE CONSTRUCTION

[75] Inventor: Hilarion Braun, Xenia, Ohio

[73] Assignee: Eastman Kodak Company, Rochester, N.Y.

[21] Appl. No.: 358,769

[22] Filed: May 30, 1989

[51] Int. Cl.[5] ..... B41J 2/05; B41J 2/14

[52] U.S. Cl. ..... 346/140 R

[58] Field of Search ..... 346/140

[56] References Cited

U.S. PATENT DOCUMENTS

| | | | |
|---|---|---|---|
| 4,312,009 | 1/1982 | Lange | 346/140 |
| 4,490,728 | 12/1984 | Vaught | 346/140 X |
| 4,580,148 | 4/1986 | Domoto | 346/140 |
| 4,611,219 | 9/1986 | Sugitani et al. | 346/140 |
| 4,746,935 | 5/1988 | Allen | 346/140 |
| 4,751,533 | 6/1988 | Saito | 346/140 |
| 4,789,871 | 12/1988 | Uddgren | 346/75 |
| 4,791,439 | 12/1988 | Guiles | 346/140 |

*Primary Examiner*—Joseph W. Hartary
*Attorney, Agent, or Firm*—John D. Husser

[57] ABSTRACT

An improved orifice construction for a bubble jet print head of the kind including a plurality of electrode-addressed resistive heater elements predeterminedly spaced in a linear array on a support substrate. Such construction includes a plurality of separator means extending up from the substrate surface at positions precisely between respective heater elements and an orifice plate fixedly mounted above the substrate and having a linear slot, of orifice width and linear array length, aligned over the heater elements and their intermediate separator members. The slot edges and separator members cooperate to define a plurality of discrete orifices that are precisely located vis a vis respective heater elements.

5 Claims, 2 Drawing Sheets

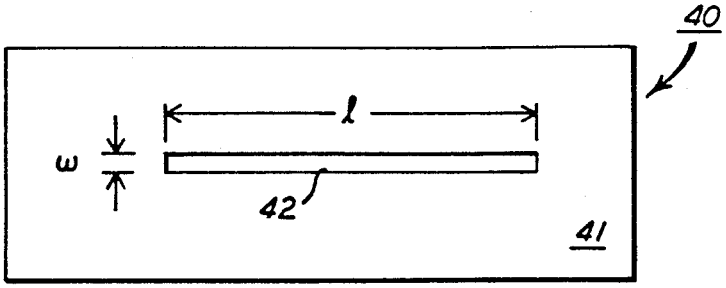
FIG. 3
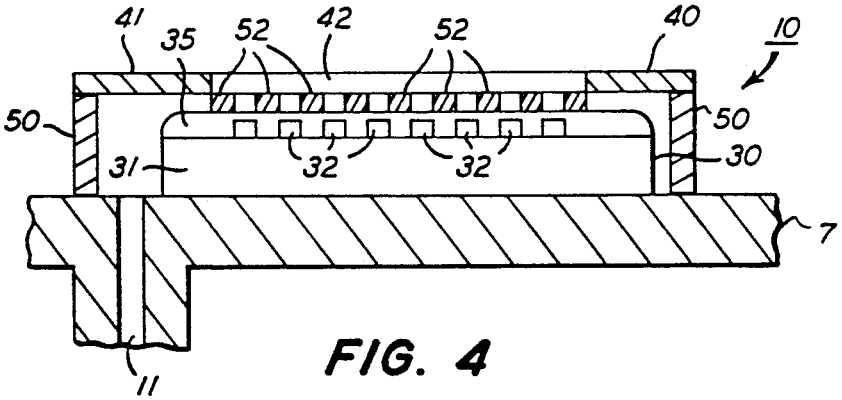
FIG. 4
FIG. 5
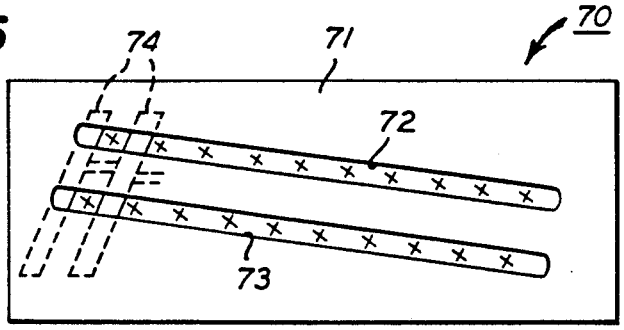

BUBBLE JET PRINT HEAD ORIFICE CONSTRUCTION

FIELD OF INVENTION

The present invention relates to thermal drop-on-demand ink jet print heads (herein referred to as "bubble jet" print heads) and, more particularly to constructions and fabrications for attaining simple, but reliable, alignment among the resistive heater elements, the ink distribution passages and the drop ejecting orifices of such print heads.

BACKGROUND ART

In bubble jet print heads a plurality of very small resistive heater elements are formed (e.g. by photofabrication) on a support (e.g. a silicon or glass chip having a heat control coating). Metal electrodes are formed on the chip to couple the heating elements for selective energization and a protective coating is provided over heat elements and electrodes. A top member is provided over at least the portion of the chip having the heater elements and ink is supplied to the region between the cap and heater elements, preferably by capillary feed from a supply reservoir. When a heater element is selectively energized, the contiguous ink is converted to steam rapidly and the resultant shock wave ejects ink from an orifice related to that heater element.

As the development of bubble jet devices has progressed, two general categories of drop ejection approach have evolved: (i) ejecting drons in a direction generally parallel to the surfaces of the heater elements and their electrical circuitry and (ii) ejecting drons in a direction generally normal to the heater element surfaces. U.S. Pat. No. 4,330,787 describes several advantages of the latter category of devices, herein termed "normal" drop ejector devices.

In prior art bubble jet print heads a variety of ink channel structures have been provided between the top cap member and the chip for purposes of fluid isolation between drop ejection zones, enhancing capillary ink transport and providing structural support between the drop ejecting chip and top member. The channel structures have been fabricated in a variety of ways, e.g. electroforming baffle elements as portions of the orifice plate/top member (see U.S. Pat. No. 4,528,577), microcutting grooves into a glass drop-ejection chip (see U.S. Pat. No. 4,330,787) and photofabricating photoresist or photopolymer channel patterns (see U.S. Pat. Nos. 4,417,251; 4,412,251 and 4,746,935).

In all such print head devices a major concern with design must be to assure that the devices can be fabricated with precise alignments between the heater elements, the channel structures and the drop ejection orifices. The photofabrication of channel structures provides a good approach for heater/channel alignment. However, orifice plates are usually separate parts from the heater elements and photofabrication alignment of orifices vis a vis heater element has not been available. This is particularly so with respect to the "normal" drop ejector devices, and in that kind of device orifice/heater element alignment is especially critical. In addition, electroplating stresses tend to shrink or elongate electroformed orifice plates vis a vis a nominal dimension. This further complicates the attainment of good heater/orifice alignment when electroformed orifice plates are used.

SUMMARY OF INVENTION

Thus one significant purpose of the present invention is to provide improved bubble jet print head constructions and fabrications which reduce the prior art difficulties in attaining good orifice and heating element alignment. A further object of the present invention is to provide an improved bubble jet print head which is simple to construct, yet reliably accurate in printing operation.

In one aspect, the present invention constitutes an improved bubble jet print head of the kind having a drop ejection chip including a plurality of resistive heater elements, predeterminedly spaced in a linear array, and electrode means for selectively addressing said heater elements. The print head comprises: (i) a plurality of separator members extending upwardly from the drop ejection chip surface at positions preisely between respective heater elements; and (ii) an orifice plate, fixedly mounted above the drop ejection chip and having a linear slot of the desired orifice width and of length slightly greater than that of the linear array, which is aligned over said heater elements and intermediate separator members. By such construction the slot edges and separator members cooperate to define a plurality of discrete orifices that are precisely located vis a vis respective heater elements.

BRIEF DESCRIPTION OF DRAWINGS

The subsequent description of preferred embodiments refers to the accompanying drawings wherein:

FIG. 3 is a plan view of one preferred orifice plate construction for cooperation with the print head portion shown in FIG. 2;

FIG. 4 is a cross-section of the FIG. 2 print head taken along lines 4—4, but with the orifice plate shown in FIG. 3 attached; and FIG. 5 is a schematic plan view of another preferred embodiment of a print head in accord with the present invention.

DETAILED DESCRITION OF PREFERRED EMBODIMENTS

Figure 1:
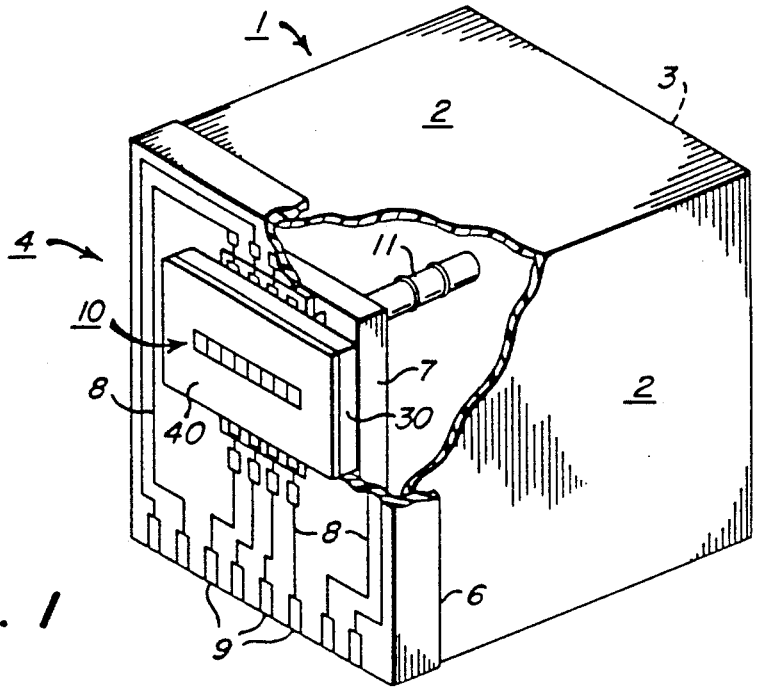
FIG. 1 is a perspective view showing an exemplary print/cartridge embodying one preferred print head construction in accord with the present invention.

FIG. 1 illustrates a print/cartridge 1 that comprises an ink container formed by side walls 2, bottom wall 3 and a top wall assembly 4, which supports a print head device 10 constructed in accord with the present invention. In this embodiment the top wall assembly 4 comprises a cap-frame 6 adapted to hold ink supply block 7 and has electrode lead connector element 8 for coupling the address and reference electrodes of the print head device to the printer at terminals 9, when the print/cartridge is inserted. As shown in FIG. 1 and in more detail in FIGS. 2 and 4, the ink supply block 7 is constructed to support print head 10 and to supply ink from the supply reservoir to the print head via conduit 11.

Figure 2:
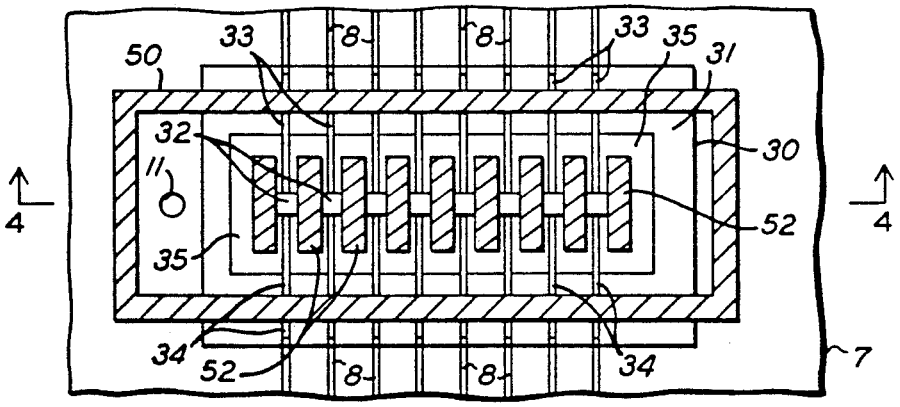
FIG. 2 is a plan view of a portion of one preferred print head construction in accord with the present invention, with orifice plate removed.

Referring to FIGS. 2 and 4 it can be seen that the print head device 10 comprises, in general, a drop ejection chip 30 and an orifice plate 40. The orifice plate is supported in spaced relation above chip 30 by wall member 50, which extends around the perimeter of the orifice plate and encloses the chip 30 and the outlet of conduit 11 to define ink manifold zone M.

The drop ejection chip 30 can be formed in a conventional manner and can include support substrate 31 on which is formed a linear array of resistive heater elements 32 that are formed in precisely spaced relation, e.g. by photofabrication and vapor deposition or sputtering techniques. Address and reference electrodes 33, 34 are coupled in pairs to each resistive heating elements 32 to enable selective heating, and dielectric passivation layer 35 is provided over the elements and their electrodes to provided over the element and their electrodes to protect it from ink.

In accord with the present invention a plurality of separator members 52 are formed on the protected chip surface at locations precisely between the resistive heater elements 32. In the embodiment shown in FIGS. 2 and 4, members 52 are a plurality of spaced parallel strips formed by photofabrication techniques to be precisely over respective spaces intermediate the plurality of resistive elements 32. In this preferred embodiment the separator members 52 also extend on either side of the line of heater element array to form separated ink channels leading to the drop ejection sites (located over each heating element). The separator members also are fabricated to have a uniform height above the surface of chip 30 and in the FIGS. 2–4 embodiment their height is such that the tops of members 52 are approximately coplanar with the top surface of wall member 50.

Further in a accord with the present invention, the print head orifice plate 40 is constructed as shown in FIGS. 3 and 4 to comprise an electroformed plate 41 having a linear slot 42 having a width "w" of the desired orifice dimension and a length "l" of a dimension slightly greater than the length of the linear array of resistive elements. The peripheral outline of plate 41 preferably corresponds in size and configuration to the outline formed by the top surface of wall member 50 so that when the orifice plate 40 is attached, e.g. by adhesive to the top of wall member 50, the manifold region M within wall member 50 is enclosed at the top by the plate portion 41, leaving outlet openings only via slot 42. The orifice plate 40 is affixed with the center of slot 42 aligned with the center line of the heater array and it will be appreciated that the separator members 52 therefore close those portions of the slot which overlie them. Thus, the cooperation of separator members 52 and slot 42 forms a plurality of print head orifices that are precisely aligned over the heater elements 32.

In operation, ink flows from the print/cartridge reservoir through conduit 11, into the region over the chip 30 and between separator members 52. When an electric current is passed through a resistive heater element 32, via electrodes 33, 34, a vapor bubble is generated in the ink channel over that heater site and a drop of ink is ejected through the overlying opening formed by cooperation of the separator members 52 and orifice slot 42.

One skilled in the art will appreciate that the separator members can be formed by various photofabrication techniques such as described in U.S. Pat. Nos. 4,417,251 and 4,412,224, e.g. employing photopolymers as photoresists. It will also be appreciated that print heads can have various configurations employing the present invention. For exmaple, FIG. 5 illustrates schematically an embodiment 70 wherein the orifice plate 71 comprises two generally parallel slots 72, 73 extending diagonally thereacross, and the separator members 74 extend between parallel linear arrays of heating sites (indicated schematically with x's), with which the orifice slots 72, 73 are respectively aligned.

The invention has been described in detail with particular reference to certain preferred embodiments thereof, but it will be understood that variations and modifications can be effected within the spirit and scope of the invention.

I claim:

1. A bubble jet print head of the kind having a drop ejection chip including a plurality of resistive heater elements predeterminedly spaced in a linear array and electrode means for selectively addressing said heater elements, said print head further comprising:

(a) a plurality of separator members extending up from said drop ejection chip surface at positions precisely between respective heater elements said separator members having substantially coplanar top surfaces at a predeterminedly capillary spacing from said chip surface; and (b) an orifice plate fixedly mounted above said drop ejection chip and having a liner slot, of desired orifice width and approximately linear array length, aligned over said heater elements and their intermediate separator members, said slot edges being coupled to separator members top surfaces to define a plurality of discrete orifices that are precisely located vis a vis respective heater elements.

2. the invention defined in claim 1 wherein said plurality of separator members comprises a plurality of parallel strip members that extend to each side of said heater element array to form separate ink channels for respective heater elements.

3. The invention defined in claim 2 wherein said strip members are photofabricated and further including a photofabricated fence member surrounding said strip members having top surfaces coplanar with said separator members' top surfaces and supporting edge portions of said orifice plate.

4. The invention defined in claim 1 wherein said separator members are photofabricated on said ejector chip.

5. The invention defined in claim 1 wherein said separator members have a predetermined height above said drop ejector chip surface to define the capillary ink spacing between said orifice plate and said chip and said orifice plate slot edges are attached to said separator members to close a plurality of slot sectors and form a plurality of predetermined size orifice openings between said closed sectors.

* * * * *